US006851757B2

(12) United States Patent
Fourie et al.

(10) Patent No.: US 6,851,757 B2
(45) Date of Patent: Feb. 8, 2005

(54) MINING METHOD

(75) Inventors: Dirk B Fourie, Centurion (ZA); Christiaan H B Van Eeden, Centurion (ZA); Jacobus H Jordaan, Elardus Park (ZA)

(73) Assignee: Eskom, Gauteng (ZA)

( * ) Notice: Subject to any disclaimer, the term of this patent is extended or adjusted under 35 U.S.C. 154(b) by 0 days.

(21) Appl. No.: 10/276,745

(22) PCT Filed: May 17, 2001

(86) PCT No.: PCT/IB01/00863

§ 371 (c)(1),
(2), (4) Date: Mar. 21, 2003

(87) PCT Pub. No.: WO01/88337

PCT Pub. Date: Nov. 22, 2001

(65) Prior Publication Data

US 2003/0168903 A1 Sep. 11, 2003

(30) Foreign Application Priority Data

May 19, 2000 (ZA) ..... 2000/2493
Sep. 13, 2000 (ZA) ..... 2000/4862

(51) Int. Cl.[7] ..... E21C 41/00
(52) U.S. Cl. ..... 299/19; 299/11
(58) Field of Search ..... 299/11, 12, 19

(56) References Cited

U.S. PATENT DOCUMENTS 2,761,663 A * 9/1956 Gerdetz
2,859,682 A 11/1958 Joy ..... 98/50
3,402,968 A 9/1968 Fischer ..... 299/11
3,695,714 A * 10/1972 Thompson ..... 299/12
4,017,121 A * 4/1977 Trent ..... 299/11
4,165,903 A * 8/1979 Cobbs ..... 299/2
4,195,886 A * 4/1980 Roye ..... 299/11
4,198,097 A * 4/1980 Fondriest ..... 299/11
4,219,237 A * 8/1980 Sisemore ..... 299/2
4,309,059 A 1/1982 Walsh ..... 299/11
4,512,610 A 4/1985 Gilbert et al. ..... 299/13
5,265,941 A 11/1993 Marteney ..... 299/12
5,782,539 A 7/1998 Peterson ..... 299/11
5,879,057 A 3/1999 Schwoebel ..... 299/17

FOREIGN PATENT DOCUMENTS

GB 2229747 3/1990

* cited by examiner

*Primary Examiner*—Sunil Singh
(74) *Attorney, Agent, or Firm*—Baker, Botts L.L.P.

(57) ABSTRACT

A method of mining an underground ore body includes the steps of: excavating a plurality of laterally spaced first, ventilation tunnels in the ore body using an auger mining machine; excavating a plurality of laterally spaced second tunnels in the ore body, each second tunnel intersecting at least one associated first tunnel and thereby defining a plurality of first support walls for supporting a roof of the mine, the first support walls comprising regions of the ore body intermediate adjacent second tunnels and each first support wall having a portion of at least one first tunnel extending laterally therethrough; providing a plurality of lateral conduits, each of which is aligned across a respective second tunnel between respective first tunnel portions defined in adjacent first support walls, to provide a series of continuos ventilation tunnels; backfilling the second tunnels to provide a plurality of second support walls for supporting the roof of the mine; and excavating the first support walls.

7 Claims, 10 Drawing Sheets

MINING METHOD

FIELD OF THE INVENTION

THIS INVENTION relates to mining and to a method of mining. In particular, the invention relates to a method of mining for use in underground mining. More particularly, the invention relates to a method of mining for use in the underground mining of coal.

BACKGROUND TO THE INVENTION

In this specification, the term "ore" is to be given a wide interpretation and includes minerals, such as coal, and the like.

In underground mining, particularly coal mining, in which continuous cutter mechanical mining machines are employed, an ore body is commonly exploited by excavating of a first series of parallel, spaced tunnels in the ore body followed by the excavation of a second series of spaced parallel tunnels, perpendicular to the first series of tunnels, thereby creating a grid-like tunnel pattern and providing spaced columns of ore, intermediate adjacent tunnels, which act as supports for the roof of the mine. The dimensions of the tunnels are generally a function of the size of the cutting head of the mechanical mining machine used in the excavation of the tunnels. The spacing between the adjacent tunnels and, consequently, the dimensions of the pillars retained in the ore body are determined by the rock mechanical structure of the mine environment and safety considerations within the environment. Amongst such safety considerations is the build-up of noxious and explosive gases within unventilated areas of the mine. In general, where a human-operated continuous cutter mining machine having a traveling cutting head is in use in the excavation of a tunnel, the lateral cross tunnels must be arranged at intervals to ensure the provision of fresh air for the operator of the machine and to exhaust noxious gases, such as methane, accumulating in the tunnel being mined, as well as exhaust gases and mining dust from the machine itself. It is commonly the case that, in the absence of artificial ventilation, the distance between cross tunnels cannot be longer than the distance between the mining head of the machine, ie the mine face, and the position of the operator on the machine. This may have the result that the percentage of the ore body extracted by mechanical mining machines in an initial series of cuts is relatively low and the mining process is inefficient.

SUMMARY OF THE INVENTION

According to a first aspect of the invention there is provided a method of mining an underground ore body, the method including the steps of excavating at least one first tunnel in the ore body by means of an auger mining machine; and excavating at least one second tunnel in the ore body, the, or each, second tunnel coinciding in at least one point with at least one associated first tunnel.

In this specification, the words "auger mining machine" are to be given a wide interpretation and include any tunneling, drilling or excavating machine having, as an excavating means, an auger bit by means of which a tunnel or passageway is excavated.

In a preferred embodiment of the invention, the, or each, first tunnel is a ventilation tunnel. It will be appreciated that such a first tunnel may provide ventilation at the time when excavated, or may be incorporated into a ventilation system of the mine, on connection to a ventilation passageway.

The method may include excavating a plurality of spaced first ventilation tunnels. The first ventilation tunnels may be generally co-parallel. Further, the, or each, second tunnel may intersect the, or each, associated first tunnel.

The method may include excavating a plurality of spaced second tunnels to provide first support walls for supporting a roof of the mine, the first support walls comprising regions of the ore body intermediate adjacent second tunnels and each first support wall having a portion of at least one first tunnel extending laterally therethrough.

The second tunnels may be generally co-parallel. Further, the second tunnels may be orientated generally perpendicularly with respect to the first ventilation tunnels. Preferably, the co-parallel ventilation tunnels are arranged laterally across a panel defined in the ore body. Then, the second tunnels are preferably orientated longitudinally along the panel and perpendicular to the ventilation tunnels.

Once a panel of the ore body has been mined out as described above, a series of parallel first support walls will remain as supports for the roof of the mine. Each of the first support walls will have a series of lateral ventilation holes defined therein, being portions of the first tunnels. The width of the first support walls will be determined by rock mechanical constraints. The first support walls within the panel may be conveniently removed in a secondary mining operation. Thus, the method may include the steps of backfilling the second tunnels to provide second support walls for supporting the roof of the mine; and excavating the first support walls.

Further the method may include the step of providing a plurality of lateral conduits, each of which is aligned across a respective second tunnel between respective first tunnel portions defined in adjacent support walls to provide a series of continuous ventilation tunnels.

Preferably, the, or each, second tunnel is excavated using a continuous cutter mining machine. Commonly, such continuous cutter mining machines are traveling mining machines having rotating cuffing heads. Generally the rotating head has one or more bits for cutting into the ore body. Then, it will be appreciated that the length of the ventilation tunnels will be limited only by the operating parameters of the auger and the machine driving the auger, and geological and mine layout parameters. Further, having provided a series of cross-ventilation tunnels, the length of each pass of the continuous cutter mining machine will be limited only by constraints such as the provision of services to the machine, the provision of infrastructure, such as conveyors, for the removal of ore, and by geological factors.

In another embodiment of the invention, the, or each, second tunnel is generally parallel with its associated first tunnel.

The step of excavating the, or each, second tunnel may comprise widening at least a portion of its associated first tunnel.

Preferably, the first ventilation tunnels are co-parallel and are directed laterally across a panel defined in the ore body. It will be appreciated that the length of the ventilation tunnels will be limited only by the operating parameters of the auger and the machine driving the auger, and geological and mine layout parameters. In a preferred embodiment of the invention, the ventilation tunnels span the panel and extend between an intake ventilation passageway and a return ventilation passageway defined in the ore body. There may be a pair of contiguous panels having a common return or intake ventilation passageway therebetween, each panel being bounded on a side opposed to the common passageway by the other of the return or intake ventilation passageways. Then, in each panel, a series of spaced ventilation tunnels may be excavated to span the panel between its return and intake ventilation passageways.

Thus, the method may include providing, in the ore body, an intake ventilation passageway and a return ventilation passageway spaced laterally from the intake ventilation passageway, the, or each, first tunnel spanning that portion of the ore body between the intake and return ventilation passageways.

As before, the, or each, second tunnel may be excavated by means of a continuous cutter mining machine. Instead, the, or each, second tunnel may be excavated by means of drilling and blasting.

There may be a plurality of first tunnels and the method may include the step of excavating a plurality of spaced second tunnels to provide first support walls for supporting a roof of the mine, the first support walls comprising regions of the ore body intermediate adjacent second tunnels. The width of the support walls will generally be determined by rock mechanical constraints. Then, the method may include the further step of mining out the first support walls.

According to a second aspect of the invention there is provided a method of backfill mining of an underground ore body, the method including the steps of excavating at least one first region of the ore body to retain at least one second region defined in the ore body, the, or each, second region providing a first support for a roof of the mine;

backfilling at least one of the excavated first regions to provide a second support for the roof of the mine; and excavating at least a portion of the, or at least one of, the second regions of the ore body.

There may be plurality of first regions of the ore body, the first regions comprising spaced generally parallel tunnels defined in the ore body, and a plurality of second regions, the second regions providing generally parallel spaced walls each of which is intermediate adjacent tunnels, and the method may include the steps of backfilling the tunnels to replace the excavated ore and to provide the second supports for the roof of the mine; and excavating the walls of the second regions.

The invention is now described, by a way of example, with reference to the accompanying diagrammatic drawings.

DETAILED DESCRIPTION OF THE DRAWINGS

Figure 1:
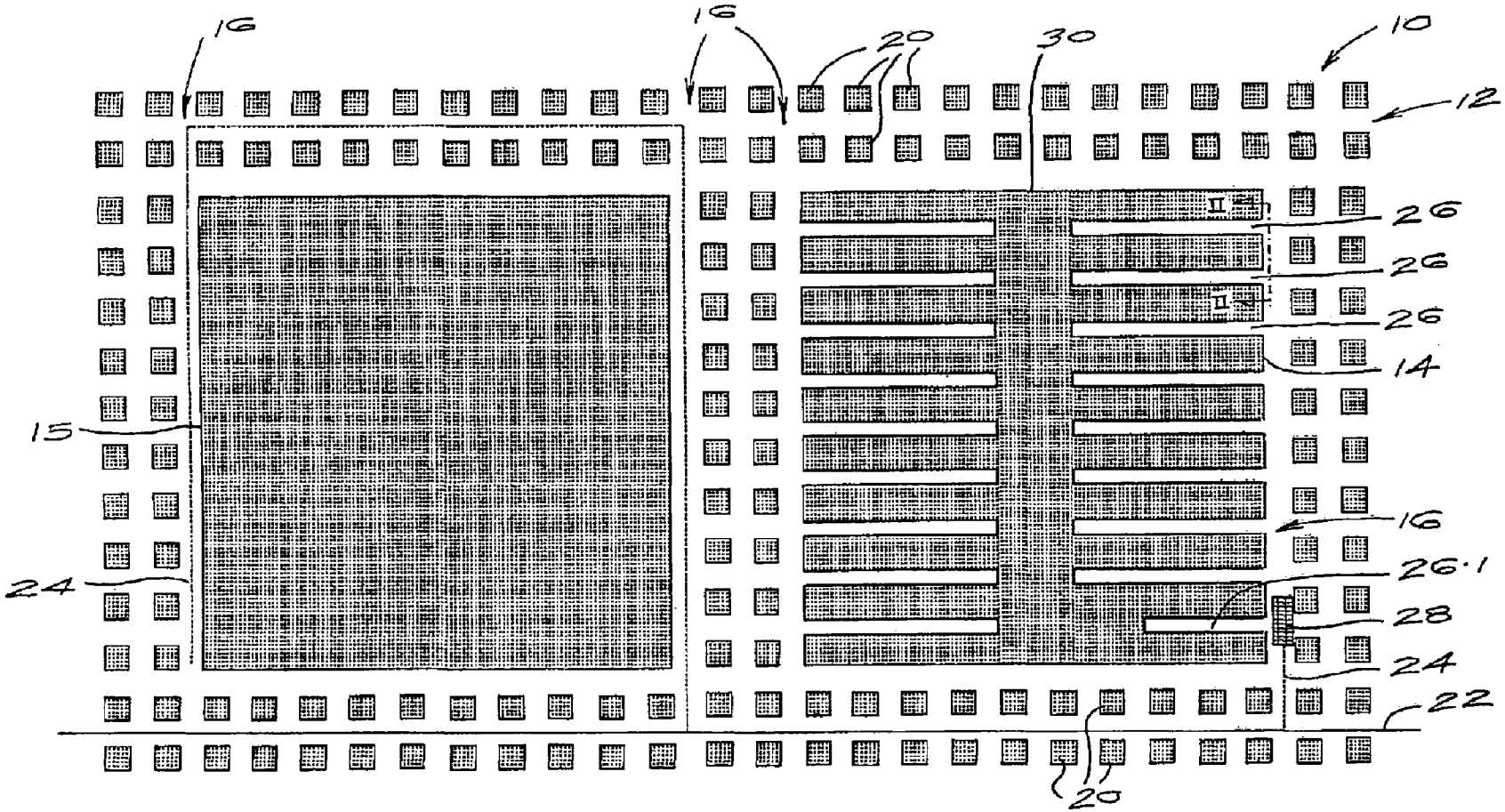
FIG. 1 shows a schematic sectional plan view of an ore body in a first phase of mining of an underground ore body according to the method of the invention.

In the drawings, reference numeral 10 generally indicates a portion of an underground mine in which a method of mining, in accordance with the invention, is in use.

In FIG. 1, an ore body 12 of coal is shown. A pair of rectangular ore panels 14, 15 is defined in the ore body 12 for ease of recovery. It will be appreciated that, depending on the circumstances in the mine, the panels 14, 15 need not be rectangular, particularly where mining is carried out towards remnants, dykes, boundaries, or the like. Roadways 16 for the provision of services and the movement of machinery are provided, surrounding each of the ore panels. It will be appreciated that a single roadway may be sufficient. The roof 18 of the mine surrounding the ore panels 14, 15 is supported by a series of pillars 20 between the roadways 16, each pillar comprising a body of unmined coal. A main trunk conveyor 22 is provided, to which are connected secondary conveyor belt installations 24 for the removal of excavated coal ore. Panel 14 shows a series of completed transverse generally horizontal ventilation tunnels 26 which have been excavated by an auger mining machine 28. The auger mining machine 28 (not shown in detail) is of a known type, including a drilling head for providing rotational and axial displacement to an auger bit, means for driving the drilling head, and an auger bit mounted on the drilling head for rotation and axial displacement. The auger bit comprises a plurality of bit sections, or flights, which are dismountably interconnected, end-to-end to provide a bit of a pre-selected length. Generally, the machine is operable to travel along a roadway 16 in the mine 10, the auger bit being orientated to excavate tunnels 26 generally transversely orientated with respect to the roadway 16. In a preferred embodiment of the invention, the auger mining machine 28 has multiple drilling heads to enable the simultaneous drilling of a plurality of tunnels 26. Instead, one drilling head may be used for the removal of auger flights from one tunnel 26, while another drilling head may be used for the excavation of another tunnel 26. The auger mining machine 28 also has ancillary support components, including as a conveyor system for the removal of excavated ore. The auger mining machine 28 is shown in the process of excavating a final transverse ventilation tunnel 26.1. The ventilation tunnels 26 do not extend entirely across the width of the panel 14 and a central wall 30 is retained between opposing sets of ventilation tunnels 26. Again, it will be appreciated that, depending on the circumstances, the ventilation tunnels may extend entirely across the width of the panel 14, obviating the need for a central wall 30.

Figure 2:
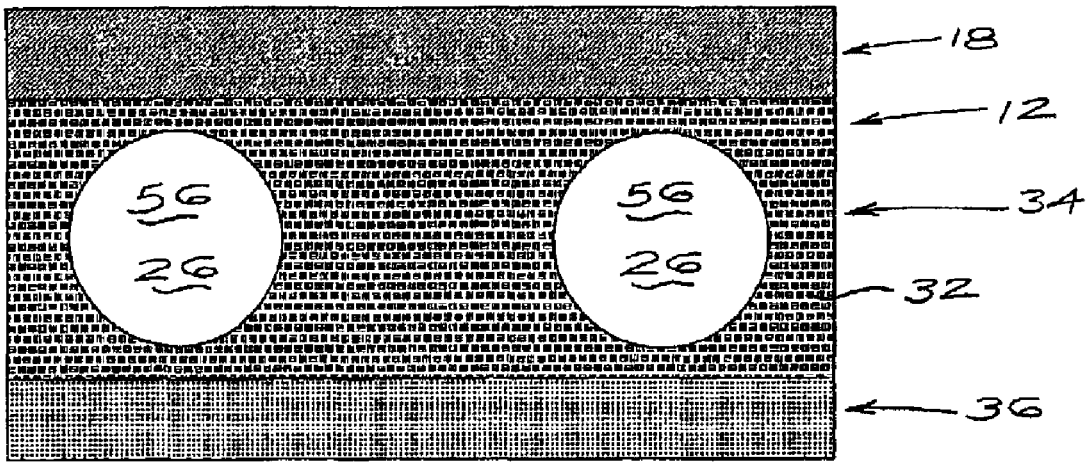
FIG. 2 shows a schematic sectional side view through a section II—II of FIG. 1.

In FIG. 2, the sectional side view of panel 14 of the ore body 12 shows a pair of ventilation tunnels 26, having been excavated by the auger mining machine 28 in panel 14. The auger tunnels 26 are excavated in the coal seam 34 intermediate the floor and roof strata, 36 and 18 respectively, of the mine. It will be appreciated that the dimensions of the auger tunnels 26 shown in the drawing are not necessarily to scale. In one preferred embodiment of the invention, the auger tunnels 26 are about 1.25 meters in diameter and the centers of the auger tunnels 26 are spaced approximately 6 meters apart. Further, the height of the coal seam 34 from floor 36 to roof 18 will be naturally determined.

Figure 3:
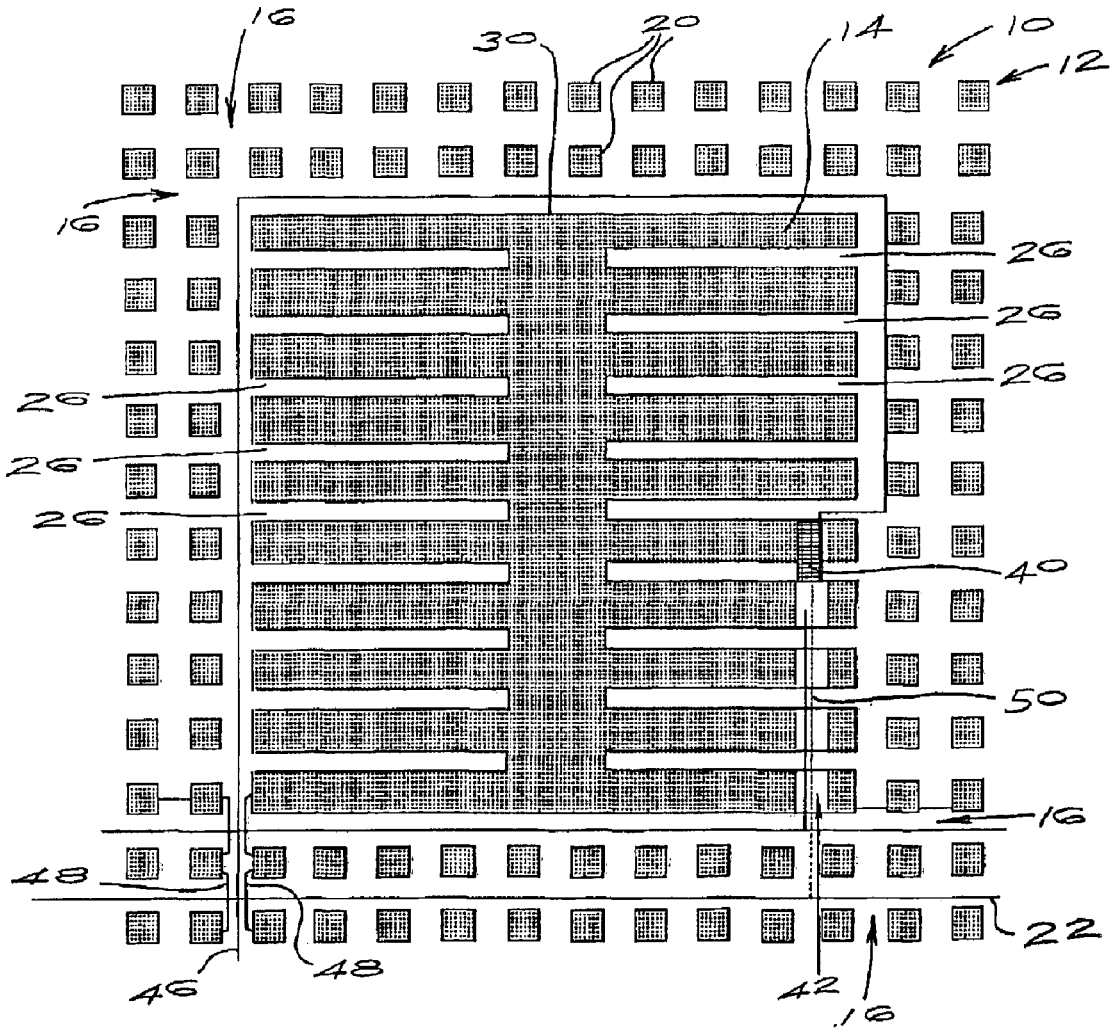
FIG. 3 shows a schematic sectional plan view of the ore body in a second phase of mining.

In FIG. 3, the excavation of transverse ventilation tunnels 26 by the auger mining machine 28 has been completed and a second phase of the method of mining is shown in process. A continuous cutter mining machine 40 having a rotating mining head (not shown) is shown excavating a first longitudinal tunnel 42 through panel 14 of the ore body 12. The longitudinal tunnel 42 excavated by the mechanical mining machine 40 is substantially perpendicular to the ventilation tunnels 26 excavated by the auger mining machine 28. Each pass of the mining machine 40 may begin on either side of the panel 14. Underground water management infrastructure will generally be provided to remove underground water.

Further, a ventilation path 46 is provided surrounding the ore body 12 and, where necessary, ventilation walls 48 are established to direct the flow of ventilating air. A conveyor and coal clearing machine system 50 is provided downstream of the mechanical mining machine 40 and is connected to the trunk conveyor 22 for removal of excavated coal ore. Still further, each ventilation tunnel 26 may require artificial ventilation prior to intersection of that tunnel 26 by a longitudinal tunnel 42, according to relevant safety requirements, especially in gaseous coal seams. This ventilation may be provided by suitable mechanical or electromechanical means.

Figure 4:
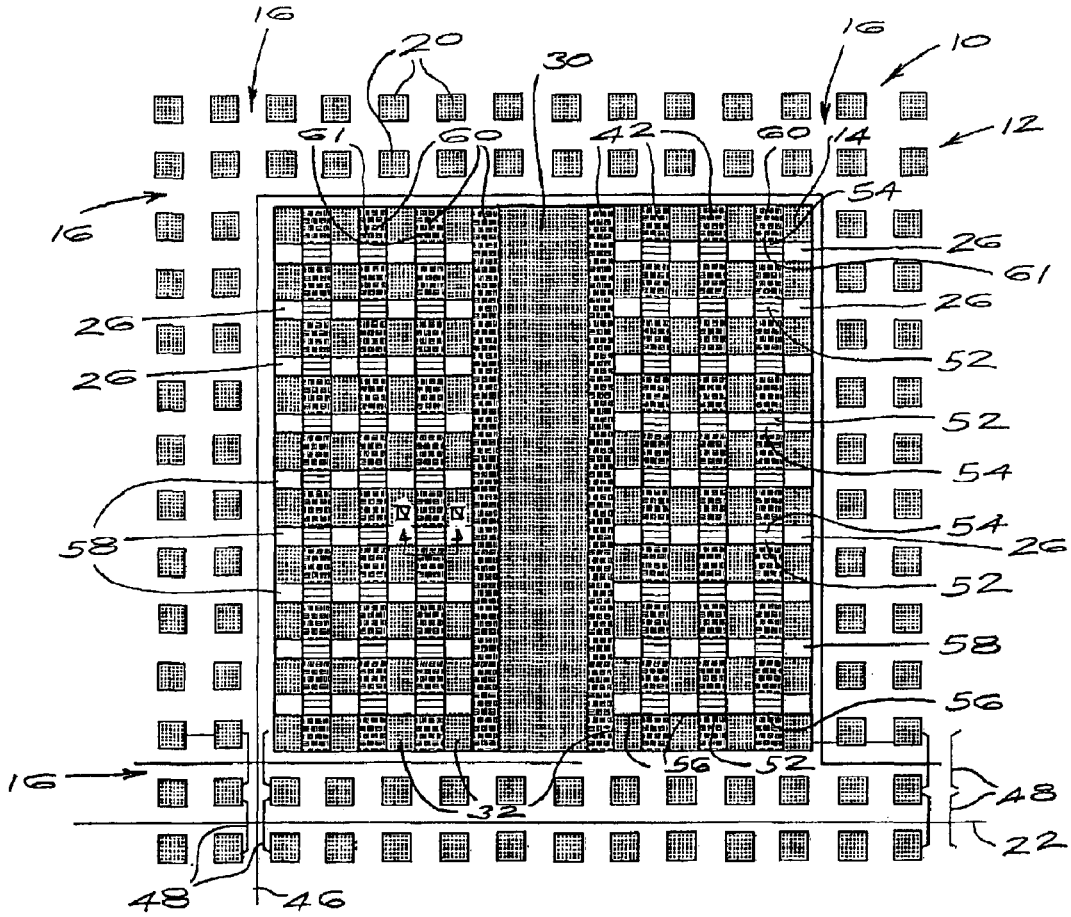
FIG. 4 shows a schematic sectional plan view of the ore body in a third phase of mining.
Figure 5:
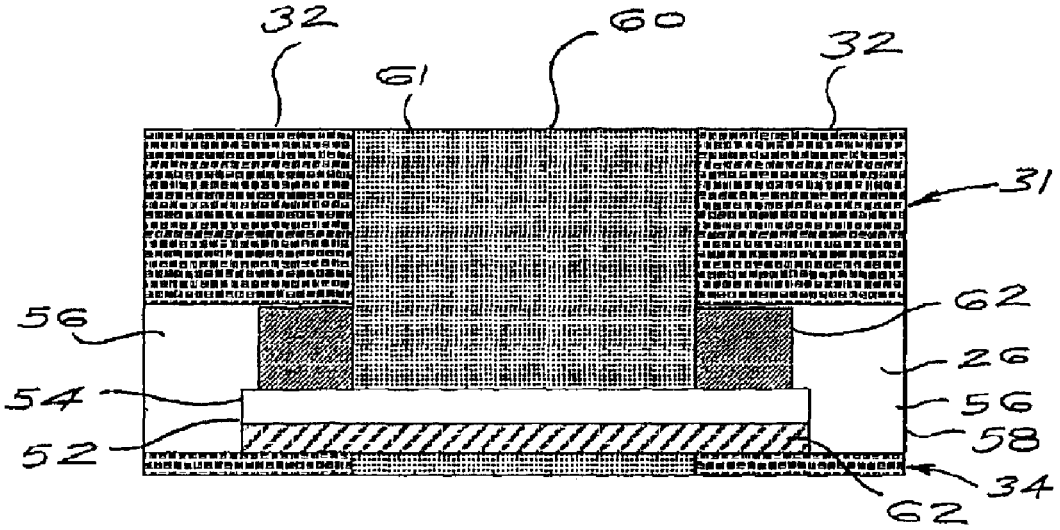
FIG. 5 shows a sectional end view through section IV—IV of FIG. 4.

In FIG. 4, the entire panel 14 of the ore body 12 has been mined out in a first phase of mining using the mechanical mining machine 40. It will be appreciated that after excavating the longitudinal tunnels 42, a series of first coal support walls 32 is defined in the ore body 12, a support wall 32 being located intermediate respective adjacent tunnels 42. A series of conduits 52 comprising perforated pipe 54 is arranged across the longitudinal tunnels 42 excavated by the mechanical mining machine 40. Each of the conduits 52 is aligned laterally across a respective longitudinal tunnel 42 between respective first tunnel portions 56 defined in adjacent first support walls 32, thereby providing a series of continuous ventilation and drainage tunnels 58. Backfilling of the longitudinal tunnels 42 has been completed and infill 60 is indicated by the shaded regions of the tunnels 42, the infill 60 providing a second support wall 61 for the roof 18 of the mine to permit remaining portions of the first support walls 32 of the ore body 12 to be mined in a secondary mining process. The placement of the perforated conduits 52 together with suitable auger hole seals 62 is shown in FIG. 5.

Figure 6:
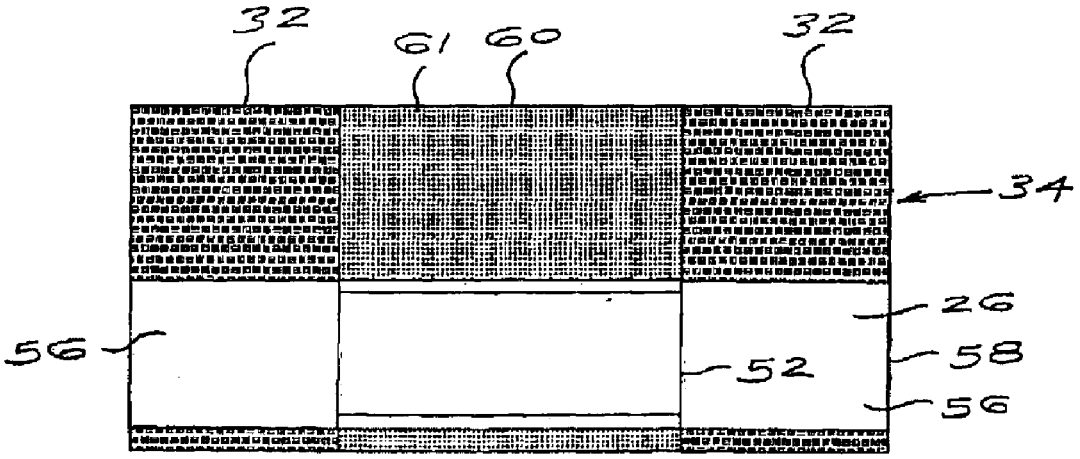
FIG. 6 shows a sectional end view through section IV—IV, using an alternative conduit system.

In FIG. 6, an alternative, and preferred, embodiment of the invention is shown, in which each of the conduits 52 is of approximately the same diameter as the tunnel portions 56 and is of a length approximately equal to the distance between adjacent first support walls 32.

We turn now to FIGS. 7 to 11, which show a portion of an underground coal mine 10 in which a second embodiment of the method of mining, in accordance with the invention, is in use. In FIGS. 7 to 11, with reference to FIGS. 1 to 6, like numerals indicated like components, unless otherwise indicated.

Figure 7:
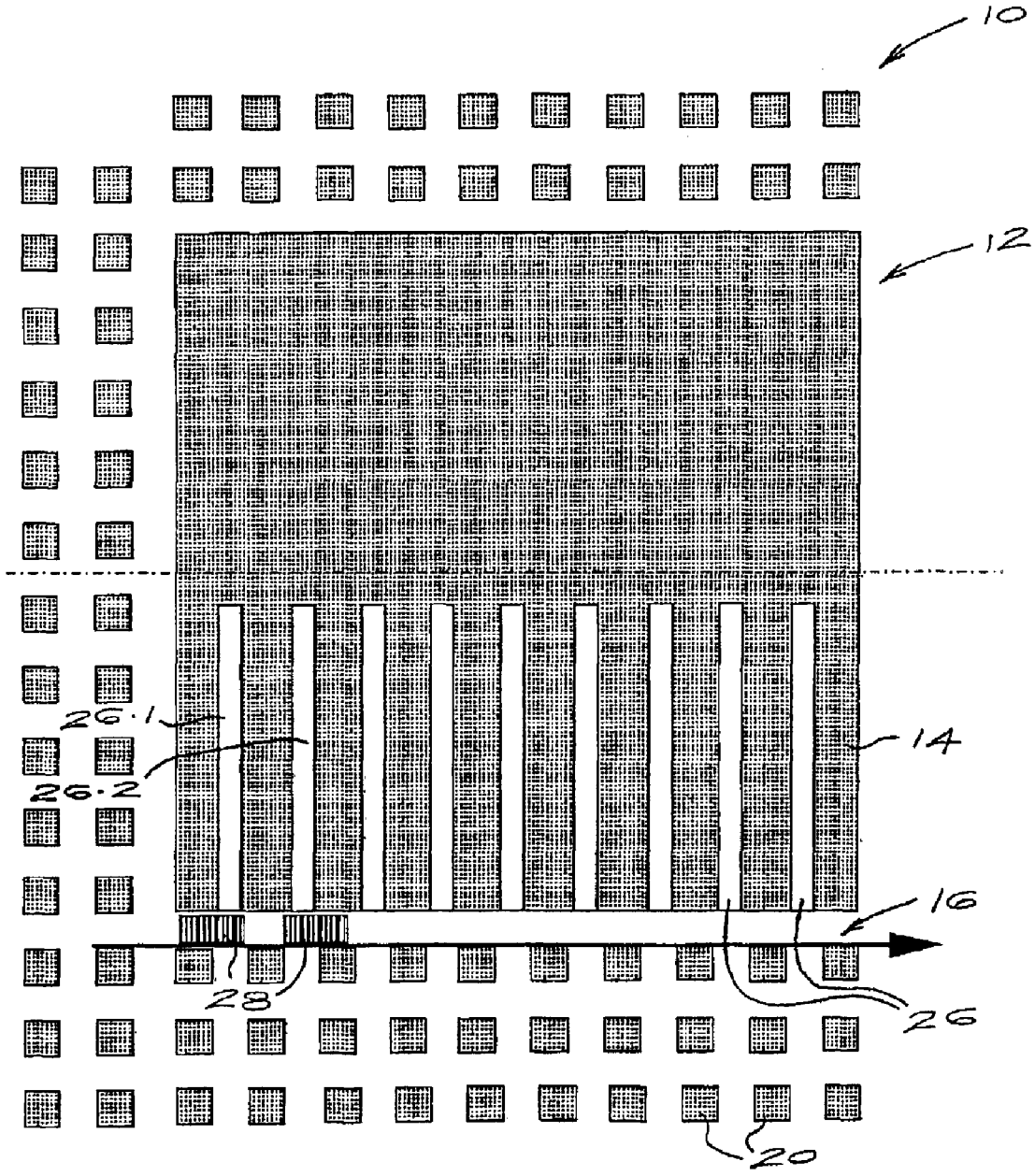
FIG. 7 shows a schematic sectional plan view of an ore body in a first phase of mining according to a second embodiment of the method of the invention.

In FIG. 7, a first series of transverse auger holes, providing first ventilation tunnels 26, have been excavated in the panel 14 by auger mining machines 28, a pair of which are indicated in place in the drawing. The auger mining machines 28 are shown in the process of completing excavation of final transverse ventilation tunnels 26.1 and 26.2.

Figure 8:
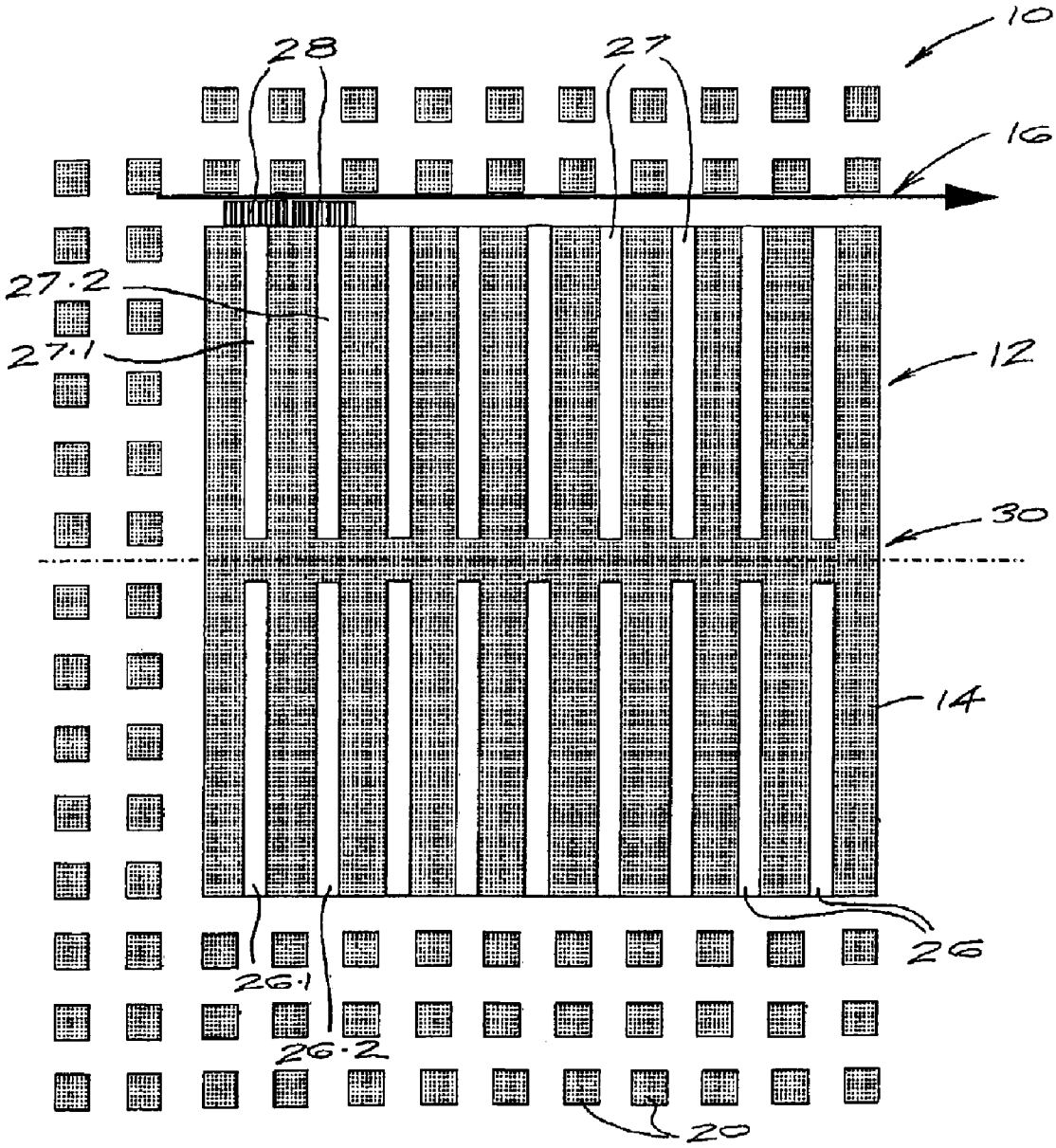
FIG. 8 shows a schematic sectional plan view of the ore body in a second phase of mining according to the second embodiment.

In FIG. 8, a second series of transverse auger holes, providing first ventilation tunnels 27, have been excavated in the opposite side of the panel 14 by auger mining machines 28, a pair of which are indicated in place in the drawing. The auger mining machines 28 are shown in the process of completing excavation of final transverse ventilation tunnels 27.1 and 27.2. The ventilation tunnels 26, 27 do not extend entirely across the width of the panel 14 and a central wall 30 is retained between opposing sets of ventilation tunnels 26, 27. It will be appreciated that, depending on the circumstances of the particular location, the ventilation tunnels 26, 27 may extend entirely across the width of panel 14.

Figure 9:
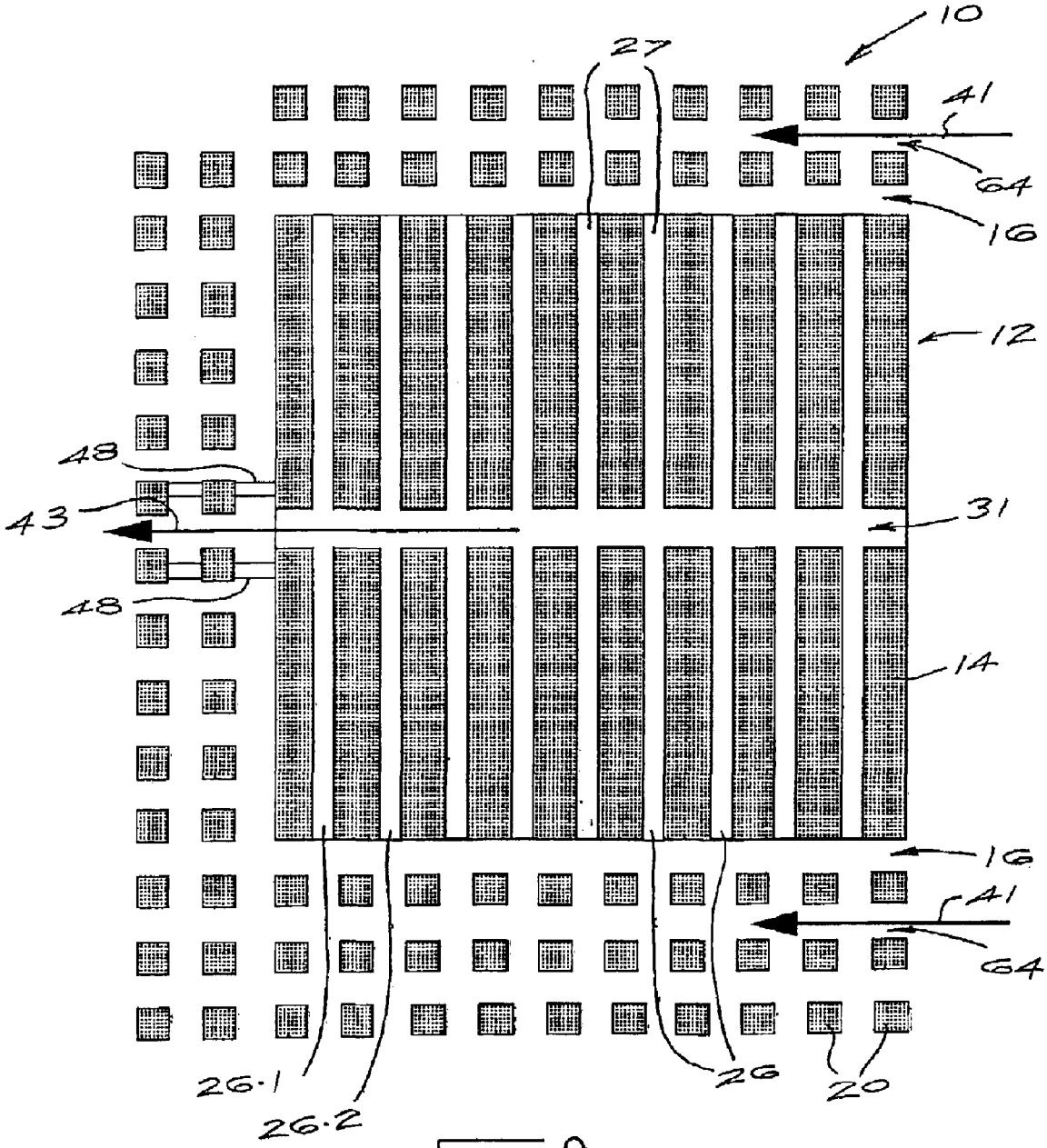
FIG. 9 shows a schematic sectional plan view of the ore body in a third phase of mining according to the second embodiment.

In FIG. 9, the excavation of transverse ventilation tunnels 26, 27 by the auger mining machines 28 has been completed and a central wall 30 has been mined out to provide a return air ventilation tunnel 31 intersecting the first ventilation tunnels 26, 27. Intake air is provided via intake air passageways 64. Thus, ventilation flow path is provided from intake air passageways 64, via the first ventilation tunnels 26, 27 to the return air ventilation tunnel 31. Ventilation walls 48 are established to direct the flow of ventilating air. The direction of flow of intake air indicated by the arrows 41 in the drawings, while the direction of flow of return air is indicated by the arrows marked 43 in the drawings.

Figure 10:
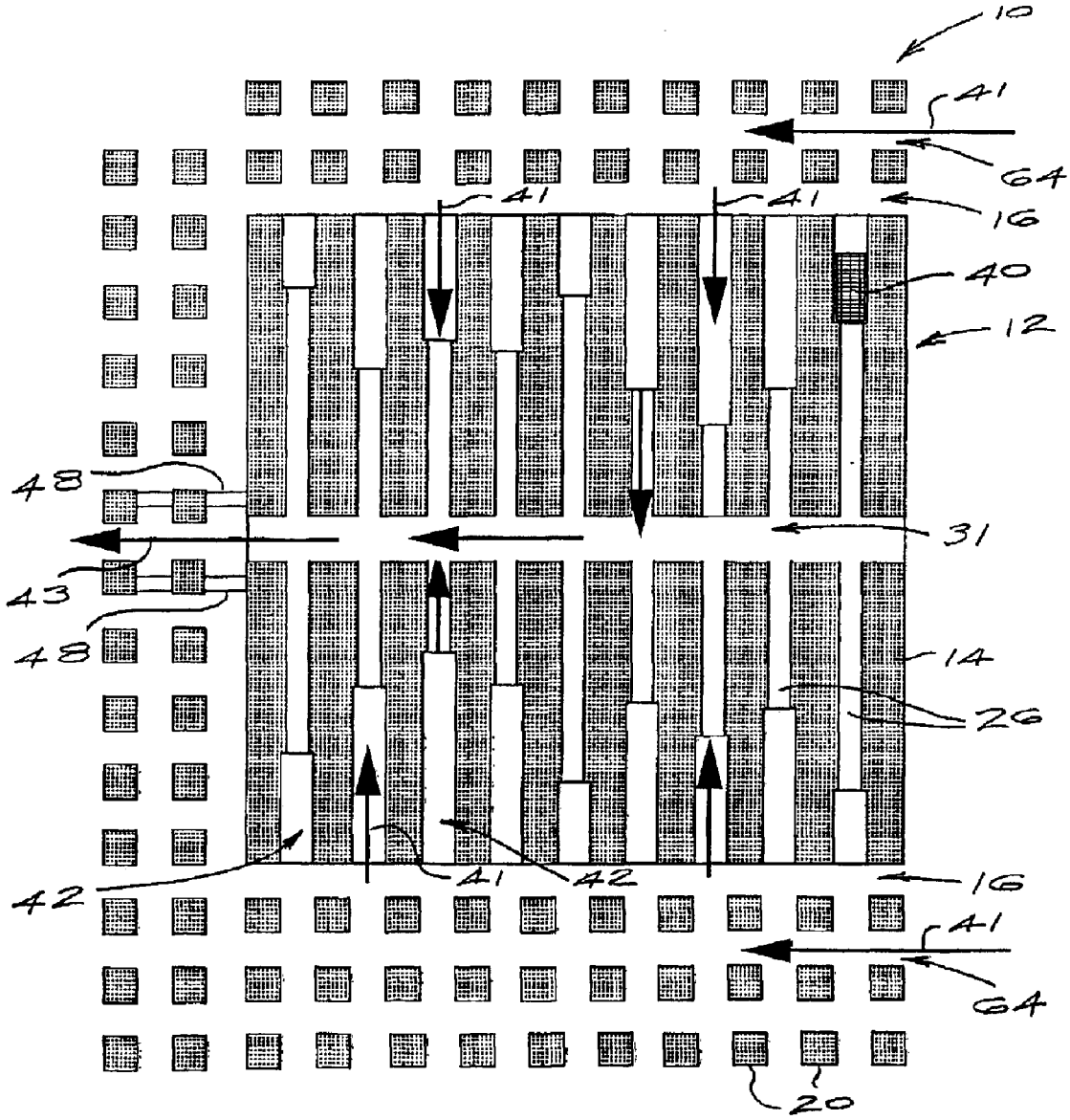
FIG. 10 shows a schematic sectional plan view of the ore body in a fourth phase of mining according to the second embodiment.

FIG. 10 shows a further stage of the mining of the ore body 12 in which continuous boards are drilled and blasted in the panel 14 from the roadways 16 towards the return air ventilation tunnel 31 along each of the first ventilation tunnels 26, 27 thereby widening the tunnels 26, 27 and providing a series of mined out second tunnels 42 (shown in various stages of completion). It will be appreciated that, instead, the second tunnels 42 could be excavated using a mechanical mining machine or other suitable method. Underground water management infrastructure (not shown) will generally be provided to remove underground water. Further, a conveyor and coal clearing machine system (not shown) is provided for removal of excavated coal ore. Still further, each ventilation tunnel 26, 27 may require artificial ventilation prior to intersection of that tunnel 26, 27 by the return air ventilation tunnel 31, according to relevant safety requirements, especially in gaseous coal seams. This ventilation may be provided by suitable mechanical or electromechanical means.

Figure 11:
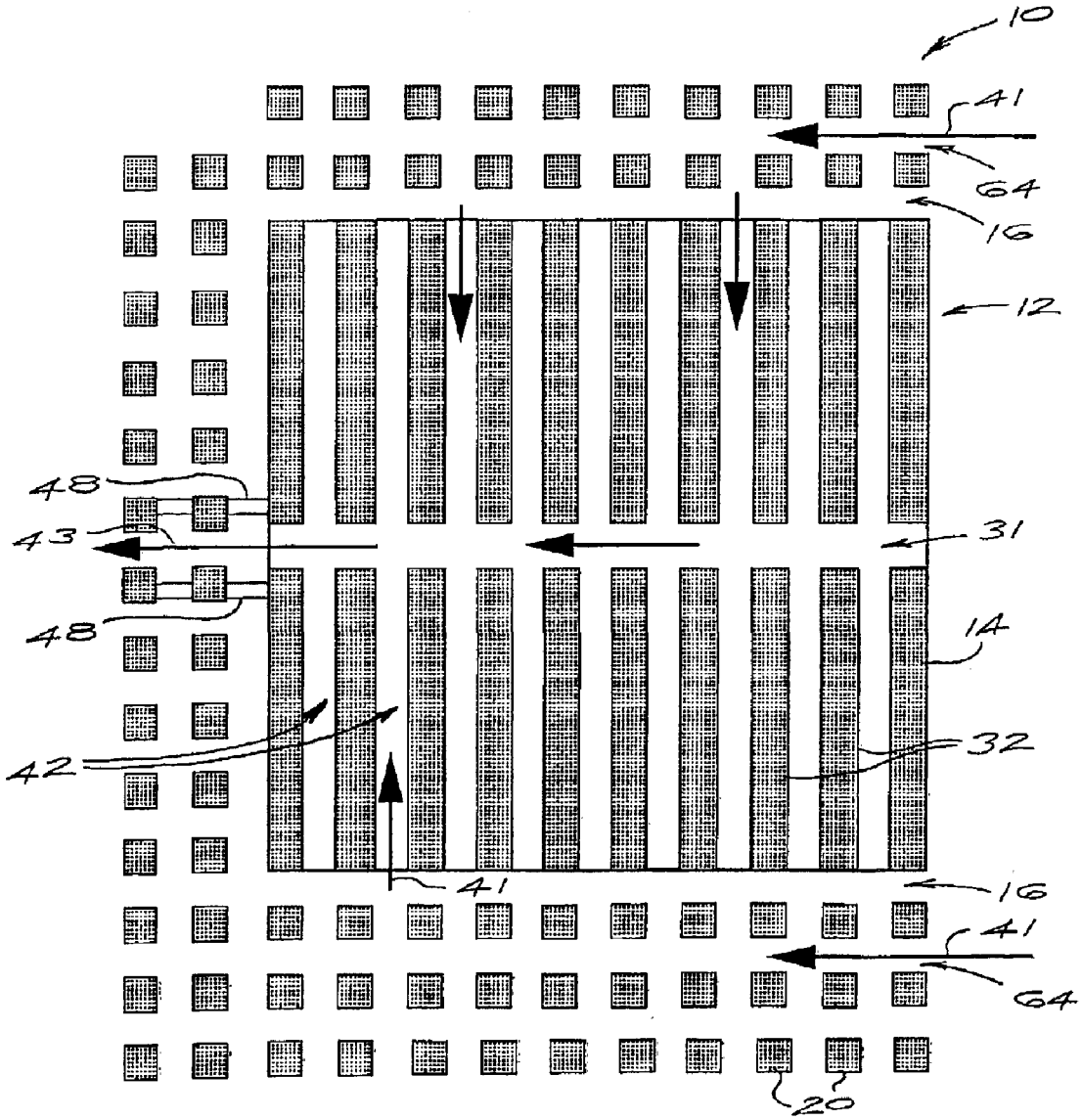
FIG. 11 shows a schematic sectional plan view of the ore body on completion of the fourth phase of mining according to the second embodiment.

In FIG. 11, the panel 14 of the ore body 12 have been entirely mined out in a first phase of the mining and the first ventilation tunnels 26, 27 have each been widened to provide a series of completed second tunnels 42, thereby bridging the intake air passageways 64 and the return air ventilation tunnel 31, and leaving a series of first support walls 32 intermediate each adjacent second tunnel 42 to provide support for the roof 18 of the mine 10. The first support walls 32 may be mined out in a second mining phase if desired.

By means of the invention there is provided a method of mining an underground ore body 12 using conventional mechanical mining equipment 40, 50, 22 and a suitable auger mining machine 28. The method allows for cross ventilation of the ore body 12, thereby enabling the mechanical mining machine 40 to operate in a relatively unrestricted manner. Safety of underground personnel is facilitated by means of cross ventilation tunnels 26, thereby inhibiting the build-up of noxious and explosive gases in the ore body 12. It is estimated that the use of the method of mining according to the invention will permit substantial increases in the rate of recovery of underground ores and will facilitate the more efficient utilization of mechanical mining machines 40 and the retaining of smaller portions of the ore body 12 for support purposes. By means of backfilling, secondary mining of the portion of the ore body 12 not mined out in the initial mining phase, is facilitated, thereby permitting the mining of a very high proportion of the ore body 12. It is anticipated that a substantially greater proportion of the ore body 12 will be removed in the initial mining phase, as compared with other methods of mining, and a correspondingly lower proportion of the ore body 12 will remain to be removed in the secondary mining phase after backfilling of the mined out portion of the ore body 12. Further, in a second embodiment of the invention, a method of mining an underground ore body 12 using conventional mechanical mining equipment or drilling a blasting and a suitable auger mining machine 28, is provided. Again, the method allows for ventilation of the ore body 12 thereby enabling the mechanical mining machine or drilling and blasting team to operate in a relatively unrestricted manner 12, whether by mechanical means or by blasting is completed.

What is claimed is:

1. A method of mining an underground ore body, comprising the steps of excavating a plurality of laterally spaced first ventilation tunnels in the ore body by means of an auger mining machine;

excavating a plurality of laterally spaced second tunnels in the ore body, wherein each second tunnel intersects at least one first tunnel and thereby defines a plurality of first support walls for supporting a roof of the mine, wherein the first support walls comprise regions of the ore body intermediate adjacent the second tunnels and wherein each first support wall having a portion of at least one first tunnel extending laterally therethrough;

providing a plurality of lateral conduits, each of which is aligned across a respective second tunnel between respective first tunnel portions defined in adjacent first support walls, to provide a series of continuous ventilation tunnels;

backfilling the second tunnels to provide a plurality of second support walls for supporting the roof of the mine; and excavating the first support walls.

2. The method of claim 1 wherein the first ventilation tunnels are generally co-parallel.

3. The method of claim 1 wherein the second tunnels are generally co-parallel.

4. The method of claim 1 wherein the second tunnels are orientated generally perpendicularly with respect to the first ventilation tunnels.

5. The method of claim 1 further comprising the step of:

providing an intake ventilation passageway and a return ventilation passageway spaced laterally from the intake ventilation passageway in the ore body, and in which each first tunnel spans that portion of the ore body between the intake and return ventilation passageways.

6. The method of claim 1 wherein each second tunnel is excavated by means of a continuous mining machine.

7. The method of claim 1 wherein each second tunnel is excavated by means of drilling and blasting.

* * * * *